United States Patent [19]

Allison

[11] 4,378,058

[45] Mar. 29, 1983

[54] REAMER-STABILIZER

[75] Inventor: Glenn L. Allison, Houston, Tex.

[73] Assignee: Smith International, Inc., Newport Beach, Calif.

[21] Appl. No.: 34,405

[22] Filed: Apr. 30, 1979

[51] Int. Cl.[3] ..... E21B 10/24

[52] U.S. Cl. ..... 175/228; 175/346; 384/92

[58] Field of Search ..... 175/227, 228, 229, 344, 175/345, 346, 347, 348, 354, 371

[56] References Cited

U.S. PATENT DOCUMENTS

| | | | |
|---|---|---|---|
| 1,837,423 | 12/1931 | Foster | 175/346 X |
| 2,122,763 | 7/1938 | Smith, Jr. | 175/346 |
| 2,923,579 | 2/1960 | Scheel | 308/36.1 X |
| 3,907,048 | 9/1975 | Gray | 175/337 X |
| 3,977,481 | 8/1976 | Fisk et al. | 175/345 X |
| 4,102,416 | 7/1978 | Hug | 175/344 X |
| 4,182,425 | 1/1980 | Garrett | 175/228 |
| 4,213,512 | 7/1980 | Mazziotti | 308/36.1 X |
| 4,227,586 | 10/1980 | Bassinger | 175/346 |

*Primary Examiner*—Ernest R. Purser

*Attorney, Agent, or Firm*—Murray Robinson; Ned L. Conley; David Alan Rose

[57] ABSTRACT

A roller reamer-stabilizer tool includes a tubular body having threaded pin and box connectors at each end adapted to be connected in a drill string and providing a fluid passage connecting the upper part of the drill string with the lower part. Rollers having integral pins at their ends are mounted in pockets in the sides of the body. The pins are journaled in holes in arcuate cross section bearing blocks received in correlative sockets in the body at the ends of the pockets. The blocks make an interference fit with the body. Release bar access passages allow a release bar to be inserted behind each block to drive, wedge or pry it out. The holes in the blocks extend only part way through the blocks, the hole in the block at one end of each roller being blind, and the wall at the end of the hole in the block at the other end of each roller being ported. Each bearing is sealed by an O ring at the mouth or open end of the hole in the block. An additional O ring is provided adjacent the end wall of the ported block. Grease is stored in a bore extending axially in each roller through the pins at each end. Radial ports in the pins communicate the bore with the bearings. A flexible elastomeric boot closes the bore at the end of each roller received in the respective ported block, the port subjecting the interior of the boot to drilling fluid pressure.

8 Claims, 2 Drawing Figures

REAMER-STABILIZER

CROSS REFERENCE TO RELATED APPLICATIONS

This application relates to an improvement upon the invention of William R. Garrett disclosed in U.S. patent application Ser. No. 799,770 filed May 23, 1977, now U.S. Pat. No. 4,182,425, issued Jan. 8, 1980 the disclosure of which is incorporated herein by reference.

Other improvements upon the invention of the aforesaid Garrett application are disclosed in the contemporaneously filed application of Glenn Allison et al Ser. No. 34,759, filed Apr. 30, 1979 and now U.S. Pat. No. 4,262,760 and William R. Garrett Ser. No. 36,066, filed May 1, 1979, and now U.S. Pat. No. 4,261,426 both entitled Reamer Stabilizer.

BACKGROUND OF THE INVENTION

1. Field of the Invention

This invention relates to roller reamer-stabilizer tools useful in the rotary system of earth boring, e.g. for petroleum wells, and more particularly to such reamers in which the rollers are replaceably mounted on the reamer body. The invention is equally applicable to reamers and stabilizers, i.e. wall contacting tools, but for simplicity and by way of example will be described with reference to reamers.

2. Description of the Prior Art

According to the aforementioned patent application a reamer includes a tubular body having a plurality of pockets thereabout to receive the rollers, which are rotatably mounted on shafts, and the ends of the shafts are mounted in blocks having sides of arcuate configuration received in correlative pockets in the reamer body, various arrangements being provided to lubricate the roller-axle areas of relative rotation, both drilling fluid lubricated and sealed bearing constructions being disclosed. A form of this construction similar to that shown in FIG. 9 of the aforementioned application has been built.

Certain prior patent art relative to such construction is discussed in the specification of the aforesaid prior application. Further prior art patent references are of record in the file of that application, including a U.S. patent to Gray, U.S. Pat. No. 3,907,048, which discloses a construction in which solid rollers are provided at their ends with integral pins which rotate in rectangular bearing blocks. See also U.S. Pat. No. 3,820,613 to White.

SUMMARY OF THE INVENTION

In roller-reamer construction in which the rollers rotate about fixed shafts, the shafts become worn on one side, the pressure side, resulting in the rollers moving radially inwardly, with a consequent loss of overall reamer diameter. It is an object of this invention to overcome this problem.

According to the present invention each roller is a solid cylinder provided at each end with pins which rotate in holes in round blocks that are removably supported in the reamer body. The blocks thus form bearings, as distinct from the mere supports for fixed shafts disclosed in the aforementioned Garrett application. Since the pins rotate, they wear evenly on all sides. Although the wear on the bearing blocks is localized on the pressure or innermost side of each bearing block hole, the bearing blocks are readily replaceable.

Although the subject invention of mounting a roller having integral pins in round bearing blocks is applicable to drilling fluid lubricated roller reamers, as set forth in the aforementioned Allison, et al patent application, there is also advantage to a sealed bearing construction as disclosed in the present application. Sealing is effected at one end of the roller by providing a bearing block with a blind hole and an O ring near the mouth of the hole. Sealing is provided at the other end of the roller by an O ring at the mouth of the hole and an additional O ring at the bottom of the hole, the added O ring being required since the bottom has a small pressure equalization port therein. Grease is stored in a chamber provided by an axial bore through the roller and its pins, the bore communicating with the bearings through radial ports in the roller pins. An enlargement of the bore at the end of the roller where the bearing pin is received within the ported block provides additional grease storage capacity and receives an elastomeric flexible tubular sack or boot, which closes the bore at that end, the interior of the boot being exposed to drilling fluid pressure through the aforementioned pressure equalization port.

The last described construction may be compared with the construction disclosed in the aforementioned U.S. Pat. No. 3,907,048 to Gray. The bearings of Gray's rollers are lubricated by drilling fluid, in this case air, received from the interior of the body through radial ports in the closed end bearing blocks. However the bearings are not sealed, the air exiting the mouth of each bearing block.

Gray's rollers are rotatably mounted in weld integrated assemblies, each assembly including a tray, receiving the roller body, and two rectangular blocks, rotatably receiving the pins on the ends of the roller. In such construction, due to the flat sides on the blocks, the whole block-tray-roller assembly is free to move axially relative to the reamer body except as limited by the ends of the blocks abutting the reamer body, so that further securement means such as screws or weldments are employed. To keep the roller-tray-block assemblies from falling radially into the interior of the reamer body through slots in the body's side walls, in which slots the assemblies are mounted, the ends of the slots are provided with shoulders or steps in their side portions. The Gray construction, a relatively light structure, is intended for air drilling, so that the fact that the rollers are received not in pockets in the body but in trays set into slots extending clear through the body, can perhaps be tolerated, but only for modest pressures of the drilling fluid.

BRIEF DESCRIPTION OF THE DRAWINGS

For a detailed description of a preferred embodiment of the invention, reference will now be made to the accompanying scale drawings wherein.

The drawings employ the conventions of the U.S. Patent & Trademark Office for patent cases relative to the identification of materials, from which it will be seen that almost the entire reamer is made of metal. Preferably all metal parts are made of steel, except the earth formation reducing means comprising the inserted teeth in the reamer rollers, which are preferably made of tungsten carbide. The O rings are preferably made of an elastomer such as rubber. The boot retaining washer may be made of plastics material or other strong rigid material. The boot is made of flexible, grease impervious material, such as a plastics material or an elastomer.

DESCRIPTION OF PREFERRED EMBODIMENT

Figure 1:
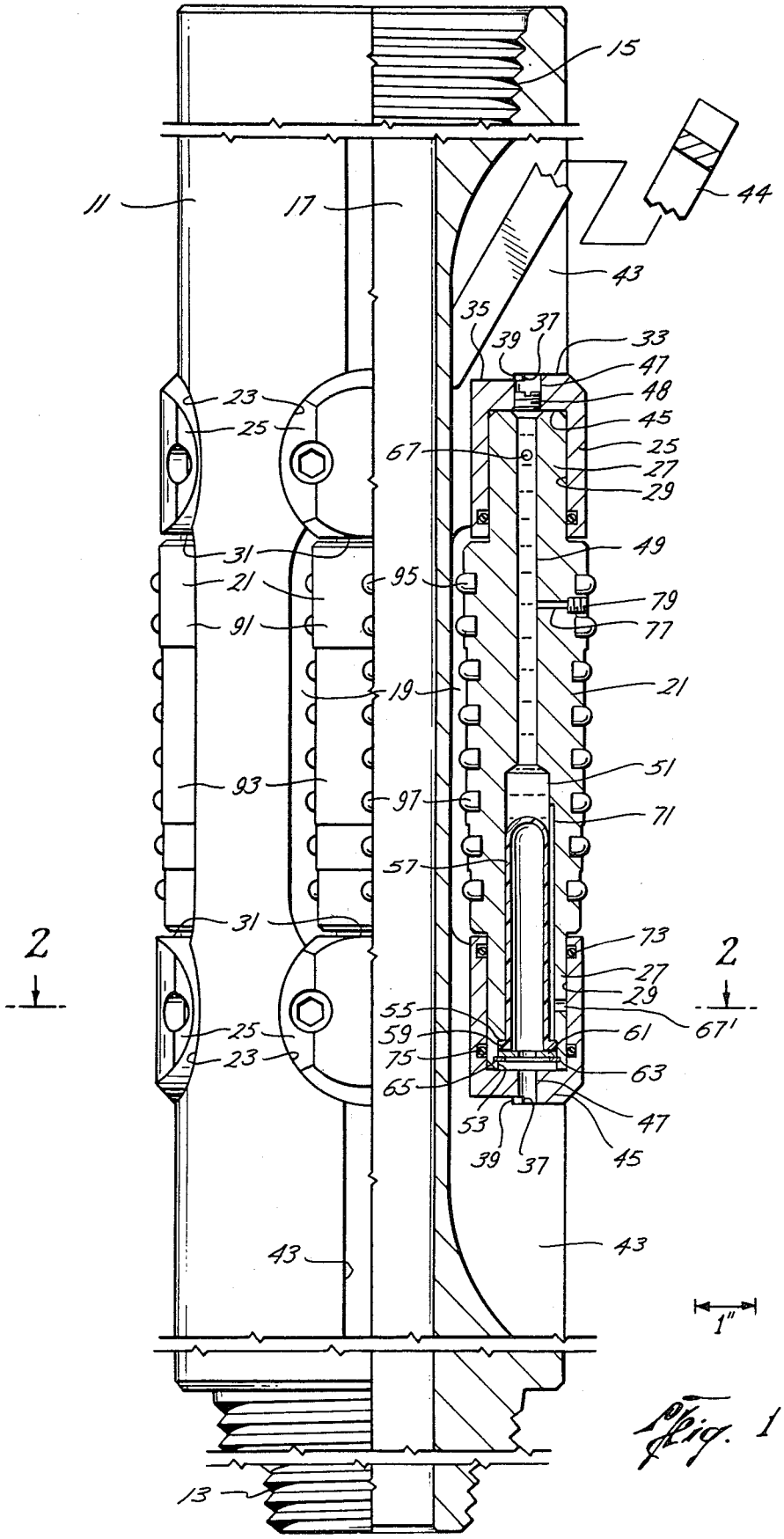
FIG. 1 is a half-section showing a reamer embodying the invention.

Referring now to FIG. 1, there is shown a reamer including a tubular body 11 having tool joint type pin and box threaded connectors 13, 15 at its ends, as might be suitable for a reamer used in the drill string some distance above the drill bit. Other forms of threaded connectors, e.g. a box on bottom and a pin or box on top, for use immediately above a drill bit, or other combinations, with a pin or box at either end, may be employed, as required for connection to adjacent drill string members. There is thus provided an impervious fluid passage 17 through the reamer from the connector 15 at the upper end to the connector 13 at the lower end.

Figure 2:
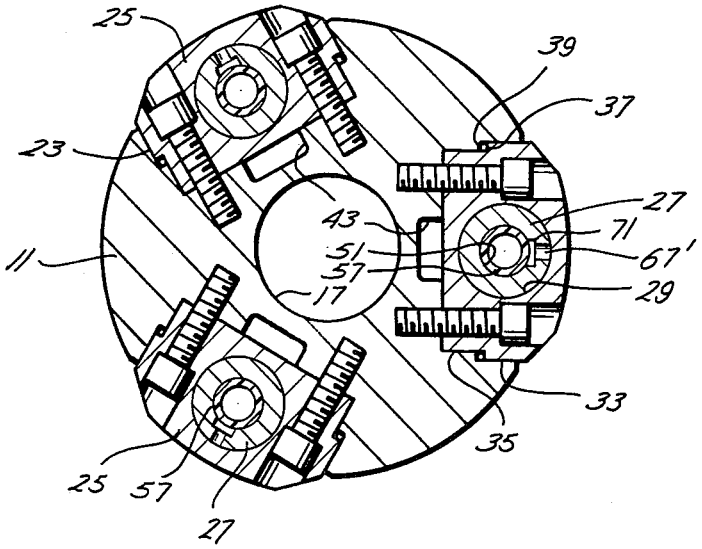
FIG. 2 is a section taken at plane 2—2 of FIG. 1.

Around the outer periphery of the reamer body are a plurality of pockets 19, each adapted to receive one of the rollers 21. FIG. 1 shows the roller pockets as though there were four of them disposed at ninety degrees to each other, thereby to facilitate showing both a straight front view and a sectional view, but preferably there are three pockets disposed 120 degrees apart, as shown in FIG. 2.

At each end of each pocket is a socket 23 within which is received, with an interference fit, a bearing block 25. Each roller 21 has a cylindrical pin 27 at each end, rotatably received in a cylindrical bore or hole 29 in one of the bearing blocks.

As described in the aforementioned Garrett patent application, sockets 23 have side walls of cylindrically arcuate configuration. Bearing blocks 25 have cylindrically arcuate side wall portions correlative to the arcuate side walls of the sockets. Portions 31 of the block side walls adjacent the ends of the rollers are plane or flat.

The arcuate side wall portions of the blocks each include a larger diameter outer part 33 and a smaller diameter inner part 35 with an arcuate step 37 therebetween. Similarly, sockets 23 have arcuate steps at 39 between parts of larger outer and smaller inner diameter. The socket steps 39 are closer to the reamer axis than the block steps 37 to insure that the blocks bottom in the sockets. The stepped construction facilitates, quick release when it is desired to remove the blocks.

As in the construction disclosed in the aforementioned Garrett patent application, the bearing blocks are provided with cap screws to serve as safety retention means, the screws passing through counter sunk holes in the blocks into threaded holes in the reamer body. When it is desired to replace a roller, the screws are removed. The reamer body is provided with slots 43 which extend underneath the radially inward parts of the bearing blocks so that a releasing bar 44 can be inserted therebehind to drive, wedge or pry out the blocks. This is more fully described in the aforementioned Garrett patent application.

Bores 29 in blocks 25 have closed ends 45. Through each end extends a port 47. The ports in the upper blocks are closed by screw plugs 48; the ports in the lower blocks are open. Ports 47 are coaxial with an axial bore 49 extending from the pin at the upper end of each roller down through the upper part of each roller to a coaxial counterbore 51. Each counterbore 51 extends through the lower end of the respective roller and the pin at the lower end of the roller. Each counterbore widens out into a socket 53 at the lower end of the pin, forming an annular shoulder 55 at the juncture of the socket and counterbore.

Within each counterbore 51 is a flexible elastomeric (rubber) sack or boot 57. The boot has an outturned lip 59 at its mouth, the lip resting against shoulder 55. A metal or plastics material washer 61 rests against the lip and is held in place by a resilient spring ring 63. Ring 63 is received in an annular groove 65 in socket 53. The interior of boot 57 is exposed to drilling fluid pressure through its mouth, washer 61, ring 63, the mouth of socket 53 and port 47 in block 25, the latter opening into slot 43 in the exterior of the reamer body.

Bore 49 and counterbore 51 are filled with a lubricant such as grease. The grease is delivered to the outer periphery of each pin 27 by a radial port 67 in the pin at the upper end of each roller and a radial port 67' in the pin at lower end of each roller, the latter communicating with the counterbore 51 via an axial groove 71 in the side of the counterbore.

The grease is retained in each of the bearing areas by an O ring seal 73 between the roots of the pin 27 and the mouth of the bore 29 in the bearing block. Since the lower bearing block has an open port 47, an additional O ring seal 75 is provided between the tip of the pin 27 and the end of bore 29. Grease is initially introduced into bore 49 and counterbore 51 through port 47 in the uppermost block 25 and the port is then closed with screw plug 48. An additional or alternative fill port 77 extending radially through each roller 21 and communicating with bore 49 may be provided, such fill port to be closed with another screw plug 79. When the reamer is in use, as grease is consumed at the bearing areas between each roller pin and bearing block bore, due to heat and pressure, additional grease is delivered to the bearing areas from the interiors of the rollers due to drilling fluid pressure expanding the boots.

In the illustrated embodiment of the reamer, the rollers have larger and smaller diameter cylindrical lands 91, 93 in which are set circumferential rows of tungsten carbide teeth 95, 97, the teeth 95 thus extending farther radially from the roller axis than the teeth 97. Other forms of bore hole wall contacting, earth formation reducing means besides teeth 95, 97 could be employed, as more fully described in the aforementioned prior Garrett patent application.

In operation, the reamer is connected in a drill string at a desired level and as the drill string is rotated in the well bore the reamer rollers cut the earth formation to maintain the hole fall gage. The rollers also help keep the drill bit and other parts of the drill string central so as to keep the hole straight.

As the drill string and reamer body rotate in the hole, the rollers, contacting the sides of the wall bore, rotate about their own axes, the pins at the ends of the rollers turning in the bearing blocks, which take the lateral thrust. As the drill string moves and turns and the rollers rotate, the roller pins may also exert end thrust on their bearing blocks, due to their weight forcing the rollers down, or due to the sides of an undergage hole causing the rollers to be held up as the drill string descends. Since the pins are free to move axially in the bearing blocks, the rollers will shift axially until the pin at one end of each roller contacts the end of the adjacent bearing block.

The distance of axial shift prior to the rollers contacting the bottoms of the holes in the bearing blocks is less than the axial shift that would be required before the ends of the rollers strike the sides of the flat sides of the bearing blocks, so that thrust is taken by the pins and bearing blocks rather than between the ends of the rollers and the sides of the blocks.

As drilling proceeds, drilling fluid is pumped down the drill string and through fluid passage 17 from the upper end of the reamer body down to the lower end of the body, and then after passing through the drill bit the drilling fluid returns back up the well bore outside the drill string. As the rising drilling fluid goes upwardly past the outside of the reamer body, it also passes through the pockets in the reamer body and cleans out the detritus from the pockets. It also pressurizes the insides of the boots to force grease from the rollers to lubricate and cool the surfaces of the interfaces of the roller pins and bearing blocks.

While preferred embodiments of the invention have been shown and described, modification thereof can be made by one skilled in the art without departing from the spirit of the invention.

I claim:

1. Apparatus useful in earth boring by the rotary method, comprising:

a tubular body, thread means at each end of the body for making a rotary shouldered connection with an adjacent drill string member, a plurality of circumferentially spaced, axially elongated pockets in the sides of the body, a plurality of rollers, each disposed in one of said pockets, and mounting means rotatably mounting said rollers to said body, said mounting means including:

a plurality of sockets in the sides of the body positioned one at each end of each pocket, a plurality of blocks disposed and releasably retained in each socket, each block being provided with an opening to receive shaft means extending from each roller into said openings in the adjacent blocks, and, shaft means comprising an integral pin at each end of each roller, said pins being rotatable in said openings in said blocks, said blocks thus constituting bearing blocks providing bearings in which said pins are journaled, each pin having a thrust bearing surface extending transverse to the pin axis, each block having a thrust bearing surface in said opening extending transversely thereof, adapted to engage a thrust bearing surface on one of said pins when the roller carrying such pin is subject to end thrust in the direction pressing the roller toward the block, said thrust bearing surface on each pin comprising the end of the pin, said thrust bearing surface on each block comprising the bottom of the opening therein, seal means sealing off a portion of the interface between each pin and the opening in the block in which the pin is received, grease reservoir means in each roller, and passage means communicating the reservoir means in each roller with said portion of said interface at the ends of the respective roller, each said seal means including an O-ring between the root of the pin and the mouth of the opening in the adjacent block, the seal means in the blocks at one end of each roller including an imperforate wall closing one end of the opening of the block, the seal means in the blocks at the other end of each roller further including a second O-ring between the pin and the opening in the block, said second O-ring being nearer the end of the pin than the first mentioned O-ring, said passage means communicating with the portion of said interface that lies between said O-rings at said other end, said reservoir means extending continuously from the distal end of said one pin through said roller into the pin at said other end, said reservoir means comprising bore means extending axially of the roller and incommunicado with the exterior of the roller through the sides of the roller throughout the length of the roller between said pins, said bore means extending axially into said pins at each end and being in open communication through said one end with the passage means at that end leading to said portion of said interface at said one end and being sealed off at the other end by flexible means exposed to fluid pressure outside the roller but open to said interface at said other end through a lateral port in said pin at said other end forming the part of said passage means at said other end.

2. Apparatus useful in earth boring by the rotary method, comprising:

a tubular body, thread means at each end of the body for making a rotary shouldered connection with an adjacent drill string member, a plurality of circumferentially spaced, axially elongated pockets in the sides of the body, a plurality of rollers, each disposed in one of said pockets, and mounting means rotatably mounting said rollers to said body, said mounting means including:

a plurality of sockets in the sides of the body positioned at each end of each pocket, a plurality of blocks disposed and releasably retained one in each socket, each block being provided with an opening to receive shaft means extending from each roller into said openings in the adjacent blocks, and shaft means comprising an integral pin at each end of each roller, said pins being rotatable in said openings in said blocks, said blocks thus constituting bearing blocks providing bearings in which said pins are journaled, each pin having a thrust bearing surface extending transverse to the pin axis, each block having a thrust bearing surface in said opening extending transversely thereof, adapted to engage a thrust bearing surface on one of said pins when the roller carrying such pin is subject to end thrust in the direction pressing the roller toward the block, said thrust bearing surface on each pin comprising the end of the pin, said thrust bearing surface on each block comprising the bottom of the opening therein, seal means sealing off a portion of the interface between each pin and the opening in the block in which the pin is received, grease reservoir means in each roller, and passage means communicating the reservoir means in each roller with said portions of said interface at the ends of the respective roller, each said seal means including an O-ring between the root of the pin and the mouth of the opening in the adjacent block, the seal means in the blocks at one end of each roller including an imperforate wall closing one end of the opening of the block, the seal means in the blocks at the other end of each roller further including a second O-ring between the pin and opening in the block, said second O-ring being nearer the end of the pin than the first mentioned O-ring, said passage means communicating with the portion of said interface that lies between said O-rings at said other end, each grease reservoir including bore means extending the length of each roller and the pins at the ends thereof, each said bore means including a bore extending axially from the pin at said one end of each roller and a counterbore of larger diameter than said bore extending axially from near the end of the pin at the other end of the roller and joining the bore, and a socket in the end of the last said pin joining said counterbore, said grease reservoir means in each roller further including a flexible sack disposed with its closed end in said counterbore and its mouth secured in said socket in the end of the respective pin.

3. Apparatus according to claim 2, each said passage means including a radial port from each said bore through the adjacent pin to the adjacent interface.

4. Apparatus according to claim 2, each said passage means at one end of each roller including a groove extending along a side of said counterbore connecting to a radial port in the adjacent pin extending to the adjacent interface.

5. Apparatus according to claim 2, including port means communicating with each said bore through which grease can be introduced into said reservoir means, and removable means closing each said port means.

6. Apparatus according to claim 5, each said port means and removable means comprising a radial port in each roller and a screw plug closing the port.

7. Apparatus according to claim 5, the opening in each block terminating within the block at a wall, each said port means and removable means comprising a port in said wall of each block at one end of each roller and a screw plug closing the port.

8. Apparatus according to claim 2, the opening in each block terminating within the block at a wall, and port means through said wall of each block at one end of each roller adjacent the socket in the pin in the end of the roller, said port means placing the sack in communication with the pressure of the fluid outside the apparatus.

* * * * *